US010000057B2

(12) United States Patent
Isal Cortes et al.

(10) Patent No.: US 10,000,057 B2
(45) Date of Patent: Jun. 19, 2018

(54) CONTROLLING NOZZLES IN A PRINT HEAD

(71) Applicant: HP SCITEX LTD., Netanya (IL)

(72) Inventors: Marc Isal Cortes, Sant Cugat del Valles (ES); Yair Shemesh, Holon (IL); Oren Perets, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days. days.

(21) Appl. No.: 15/079,353

(22) Filed: Mar. 24, 2016

(65) Prior Publication Data

US 2016/0288492 A1 Oct. 6, 2016

(30) Foreign Application Priority Data

Mar. 30, 2015 (EP) ..... 15161774

(51) Int. Cl.
*B41J 2/045* (2006.01)
*B41J 2/165* (2006.01)
*B41J 2/21* (2006.01)

(52) U.S. Cl.
CPC ..... *B41J 2/0451* (2013.01); *B41J 2/04586* (2013.01); *B41J 2/165* (2013.01);
(Continued)

(58) Field of Classification Search
CPC ..... B41J 2/0451; B41J 2/165; B41J 2/16579; B41J 2/2139; B41J 2/2142; B41J 2002/16573
See application file for complete search history.

(56) References Cited

U.S. PATENT DOCUMENTS 5,581,284 A 12/1996 Hermanson
8,120,816 B2 2/2012 Wu et al.
(Continued)

FOREIGN PATENT DOCUMENTS

EP 0500281 8/1992
EP 2308683 4/2011

OTHER PUBLICATIONS

European Patent Office, Extended European Search Report for Appl. No. 15161774.3 dated Oct. 9, 2015 (6 pages).
(Continued)

*Primary Examiner* — Geoffrey Mruk
*Assistant Examiner* — Scott A Richmond
(74) *Attorney, Agent, or Firm* — HP Inc. Patent Department

(57) ABSTRACT

Certain examples described herein relate to printing systems and methods of operating the same. In an example of a printing system, a nozzle diagnostic mechanism obtains information relating to a condition of a first nozzle set of a print head following a first period of an established printing operation, and a nozzle compensator receives information relating to the condition of the first nozzle set from the nozzle diagnostic mechanism. Based on the received information, the nozzle compensator then causes a second nozzle set of the print head to be operated in place of the first nozzle set of the print head during a second period of the established printing operation. In an example of a method of operating a printing system, status information that relates to a condition of a first nozzle set of a print head is determined during a print production operation. A second nozzle set of the print head is then caused, based on the status information determined, to be operated in place of the first nozzle set to continue the print production operation.

16 Claims, 4 Drawing Sheets

(52) U.S. Cl.
CPC ..... *B41J 2/16579* (2013.01); *B41J 2/2139* (2013.01); *B41J 2/2142* (2013.01); *B41J 2002/16573* (2013.01)

(56) References Cited

U.S. PATENT DOCUMENTS

| | | | | |
|---|---|---|---|---|
| 2005/0046658 | A1* | 3/2005 | Kojima | B41J 2/2139 347/19 |
| 2006/0158477 | A1* | 7/2006 | Kusakari | B41J 2/04561 347/19 |
| 2008/0266343 | A1 | 10/2008 | Borrell | |
| 2009/0009543 | A1* | 1/2009 | Arazaki | B41J 29/393 347/9 |
| 2009/0015621 | A1* | 1/2009 | Hirota | B41J 2/2142 347/19 |
| 2010/0066779 | A1* | 3/2010 | Gothait | B41J 2/16579 347/14 |
| 2010/0177134 | A1 | 7/2010 | Heo | |
| 2011/0222079 | A1 | 9/2011 | Bezenek et al. | |
| 2013/0278659 | A1 | 10/2013 | Bayona et al. | |

OTHER PUBLICATIONS

Seiko I Infotech Inc, SII Wide Format Solvent Inkjet Printer IP-7900-02/03, IP-7700-02/03 Advanced Operation Guide, May 2010 (99 pages).

* cited by examiner

CONTROLLING NOZZLES IN A PRINT HEAD

BACKGROUND

Printing systems allow for a printing fluid to be deposited onto a print medium. Printing fluid may be deposited onto the print medium via a print head using fluid ejection technologies. These include thermal and piezoelectric ejection technologies. The resolution of the print head may be determined by the number of individual nozzles employed in the print head. Some printing systems, such as large industrial presses, may print at a high throughput with a high image quality. For such high throughput printing systems, regular periodic servicing or maintenance may have to be performed in order to maintain a high image quality throughout the duration of a single print job.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Figure 1:
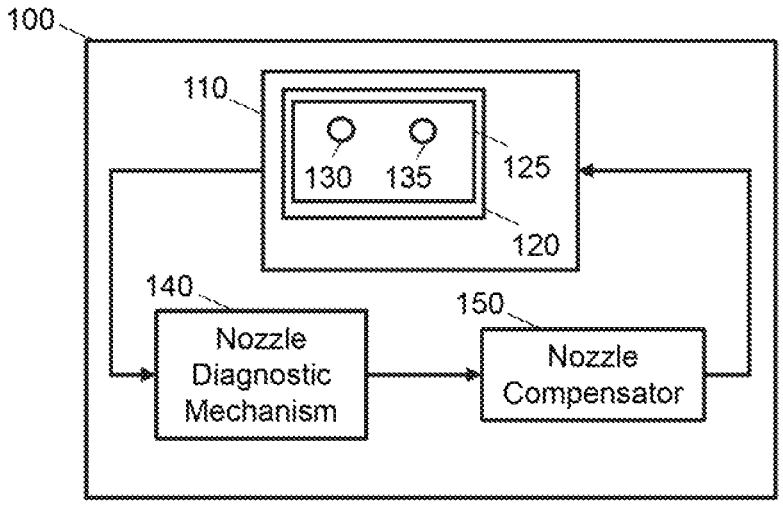
FIG. 1 is a schematic illustration showing a printing system according to an example.

As discussed certain printing systems, such as large industrial presses, may print at a high throughput with a high image quality. Such systems may use multiple print heads, each of which may have a relatively low resolution. In these cases, due to the demand for high throughput and the relatively low level of nozzle redundancy in each print head, the output quality of a print head may be increasingly sensitive to the malfunctioning of individual nozzles. Nozzles may malfunction for a variety of reasons, including misalignment, blockage, or instability. During the course of a print production job, a continual deterioration of a set of nozzles in a print head may cause the print head to repeatedly reach an image quality threshold, e.g. the threshold being representative of a respective deterioration in image quality. Every time this threshold is reached, a maintenance or servicing operation may be instructed for the print head. Not only does each servicing operation result in printing system downtime, it may often result in the wastage of a substantial amount of printing fluid, such as ink. A "printer" or "printing system" as described herein may comprise any device suitable for performing an additive manufacturing process, which may include, but not be limited to, systems for additive manufacturing in two-dimensions and/or three-dimensions.

Certain examples described herein allow for a nozzle compensation procedure to be performed during an established printing operation. As such printing fluid wastage may be avoided, and disruption to a printing operation may be minimized. In certain examples, information is obtained that relates to a condition of at least a first nozzle of a print head following a first period of an established printing operation performed by the print head. Based on the information obtained, at least a second nozzle of the print head is caused to be operated in place of the first nozzle of the print head during a second period of the established printing operation. In one described case, the information obtained is compared to a plurality of ranges indicative of different nozzle operation states. Responsive to the information obtained indicating a first nozzle operation state, the nozzle compensation procedure is performed. Responsive to the information obtained indicating a second nozzle operation state, the established printing operation is interrupted and a maintenance operation on the print head is instructed. Responsive to the information obtained indicating a third nozzle operation state, the established printing operation is continued. In one described case, the information is obtained repeatedly during the established printing operation.

Certain examples described herein reduce the wastage of printing fluid by reducing the occurrence of servicing operations on a print head. Accordingly, the extent of printer downtime may also be reduced for the same reasons, increasing the productivity rate of the printing system. Additionally, the print head itself may acquire an increased longevity, as it may be enabled to perform a print job for a longer time period without the need for replacement or servicing.

FIG. 1 shows a printing system 100 according to an example. The printing system 100 comprises a printing mechanism 110 for generating a print output. The printing mechanism 110 comprises a print head coupling 120, which, in use, is arranged to receive a print head 125 comprising a first nozzle set 130 and a second nozzle set 135. The print head 125 may be removable and/or replaceable. The printing system 100 also comprises a nozzle diagnostic mechanism 140 communicatively coupled to a nozzle compensator 150. The nozzle diagnostic mechanism 140 is configured to obtain information relating to a condition of the first nozzle set 130 following a first period of an established printing operation performed by the printing mechanism 110. The nozzle compensator 150 is configured to receive information relating to the condition of the first nozzle set 130 from the nozzle diagnostic mechanism 140 and cause, based on the received information, the second nozzle set 135 of the print head 125 to be operated in place of the first nozzle set 130 of the print head 125 during a second period of the established printing operation.

In certain cases, multiple first nozzles in the first nozzle set 130 may be flagged as malfunctioning or poorly functioning and thus be targets for compensation, and may be replaced, within the established printing operation, by multiple second nozzles in the second nozzle set 135. In certain cases, the first nozzle set 130 may be spread across multiple print heads. Likewise the second nozzle set 135 may also be spread over multiple print heads. Print heads may be configured to operate at a relatively low resolution, for example in the range 100-300 dots-per-inch (dpi). In one example, a print head may be configured to operate at 150 dpi. The print head may use thermal and/or piezoelectric actuators to eject printing fluid through the nozzles. The nozzles may also be coupled to one or more printing fluid chambers and/or reservoirs. "Nozzle" as discussed herein may refer to at least one of an ejection mechanism comprising an actuator, an aperture in a print head and any printing fluid chambers.

The printing system 100 may further comprise, according to certain examples, a control system for controlling at least one of the printing mechanism, the nozzle diagnostic mechanism and the nozzle compensator. The nozzle diagnostic mechanism may, in one case, be configured to compare the information obtained relating to a condition of the first nozzle set to a plurality of ranges indicative of different nozzle operation states. In this case, the printing system may be configured to operate the nozzle compensator responsive to the information indicating a first nozzle operation state. The first nozzle operation state may indicate that nozzle compensation is possible without a print quality metric falling below a threshold, e.g. without substantial degradation to a printed image output. In one case, the nozzle diagnostic mechanism may be configured to cause, responsive to the information indicating a second nozzle operation state, the established printing operation to be interrupted. In this case, a signal may be generated relating to the instruction of a maintenance operation on the print head. The second nozzle operation state may indicate that nozzle compensation is not possible without a print quality metric failing below a threshold, e.g. even with nozzle compensation a substantial degradation to a printed image output may occur. In a further case, the nozzle diagnostic mechanism may be configured to cause, responsive to the information indicating a third nozzle operation state, the continuation of the established printing operation. The third nozzle operation state may be associated with a nozzle operation state that results in a print quality metric being above a predefined quality threshold, e.g. a "good" operational state. The continuation of the established printing operation may be performed without the instructing of a maintenance operation on the print head or the operating of the nozzle compensator.

The nozzle diagnostic mechanism may be further configured, according to certain examples, to obtain information relating to a condition of a first nozzle set repeatedly during the established printing operation. In at least one example, the nozzle compensator may be further configured to perform repeatedly both the receiving of said information and the causing, based on the received information, a second nozzle set to be operated in place of the first nozzle set during the established printing operation. As such the first and second nozzle sets may change during each repetition. In one example, the nozzle diagnostic mechanism may be configured to perform repeatedly during the established printing operation the causing of the printing operation to be interrupted and the generating of the signal relating to the instruction of a maintenance operation on the print head.

In one example, the nozzle diagnostic mechanism may be configured to obtain information relating to a condition of at least one nozzle following a first period of an established printing operation based on information obtained during a previous printing operation. The nozzle diagnostic mechanism may, according to one example, be configured to obtain information relating to the first nozzle set, the first nozzle set comprising nozzles that are not suitable for use in a printing operation. The first nozzle set may not be suitable for use in a printing operation due to malfunction, degradation, or otherwise being in a poor operational state, according to various examples. The nozzle diagnostic mechanism may be further configured to obtain information relating to the second nozzle set, the second nozzle set comprising nozzles that are suitable for use in the printing operation. In one case, the nozzle compensator may be configured to perform a nozzle compensation process. The nozzle compensation process may, according to one example, comprise instructing at least one nozzle of the second nozzle set to be operated in place of at least one nozzle of the first nozzle set during an established printing operation. The nozzle diagnostic mechanism may, according to some examples, comprise control electronics to instruct the printing of a calibration pattern onto a print medium. The calibration pattern may comprise information indicative of a condition of at least one nozzle of the print head. In one example, the calibration pattern may comprise a plurality of predetermined positions, where each predetermined position is representative of a particular nozzle of the print head. At each predetermined position, the condition of the corresponding nozzle may be indicated by a mark, line, dot or other symbol which may be deposited by the print head upon the print medium upon instruction by the nozzle diagnostic mechanism. In some examples, the absence of such a mark, line, dot or other symbol at a predetermined position after the printing of the calibration pattern may be indicative of the corresponding nozzle being in a malfunctioning state, or of being in a malfunctioning state during the first period of the established printing operation.

The nozzle diagnostic mechanism may further comprise, according to several examples, a sensor for obtaining information relating to the calibration pattern printed upon the print medium. In one such example the obtained information may comprise an image of the calibration pattern. The sensor may be connectively coupled to the control electronics. In at least one example, the control electronics may be configured to receive the information relating to the calibration pattern obtained by the sensor and to determine, based on the calibration pattern, the condition of the at least one nozzle of the print head. Said determination may, according to one such example, comprise comparing the received information relating to the printed calibration pattern with at least one predefined value. The at least one predefined value may be based on a predefined calibration pattern. In certain other examples, the information obtained by the sensor relating to the printed calibration pattern may be sent to the nozzle compensator, which may be configured to determine the condition of the at least one nozzle based on the calibration pattern. In one example, the nozzle diagnostic mechanism may be further configured to determine the number of malfunctioning nozzles of a print head.

The nozzle diagnostic mechanism may be further configured, according to one example, to obtain information indicating whether at least one nozzle of the print head was redundant during the first period of the established printing operation. In another example, information indicating whether at least one nozzle of the print head was redundant during the first period of the established printing operation may be obtained by the nozzle compensator. In one example, the nozzle diagnostic mechanism may be further configured to determine the number of redundant nozzles of a print head. In another example, the number of redundant nozzles of the print head may be determined by the nozzle compensator.

According to certain examples, the nozzle diagnostic mechanism may be configured to determine whether to instruct a nozzle compensation procedure. In certain other examples, the determining of whether to instruct a nozzle compensation procedure may be performed by the nozzle compensator. The determining whether to instruct a nozzle compensation procedure may be based on, amongst other factors, the number of nozzles of the print head determined to be malfunctioning, and/or the number of nozzles of the print head determined to be redundant.

The nozzle compensator may, according to certain examples, comprise control electronics configured to communicate with the print head. In at least one example, the control electronics may be configured to determine, based on information received from the nozzle diagnostic mechanism indicative of a malfunction of a first nozzle, whether a second nozzle may be suitably operated in place of the first nozzle. Said determination may be based on, amongst many factors, whether the second nozzle was determined to be malfunctioning during the first period of the established printing operation, and whether the second nozzle was determined to be redundant during the first period of the established printing operation. In one example, the nozzle compensator may determine that the second nozzle may be suitably operated in place of the first nozzle if the second nozzle was not malfunctioning and was redundant during the first printing period. The control electronics may, according to certain examples, employ computer program code comprising control instructions for allocating a second nozzle to replace the first nozzle during the second period of the printing operation. In several examples, the control electronics may be configured to generate a signal based on the determination whether the second nozzle may be suitably operated in place of the first nozzle. In one such example, the generated signal may be received by the print head, and may comprise instructions for operating the second nozzle in place of the first nozzle.

The information relating to a condition of a nozzle may, according to various examples, relate to a health condition of the nozzle. The health condition may comprise an indication of whether the nozzle is malfunctioning. The nozzle may be determined to be malfunctioning if it is blocked, clogged, misaligned, flipped, unstable, missing, or is otherwise not functioning within a predefined range of parameters. In one example, the information relates to a health condition of at least a first and a second nozzle of a print head.

In some examples, status information may be obtained prior to the causing of the second nozzle to be operated in place of the first nozzle, said status information indicating that the second nozzle is not presently malfunctioning or was not malfunctioning during the first period of the established printing operation. In other examples, said status information may indicate that the second nozzle is presently redundant or was redundant during the first period of the established printing operation. In another example, said status information may indicate the position of the second nozzle relative to the first nozzle.

Figure 2:
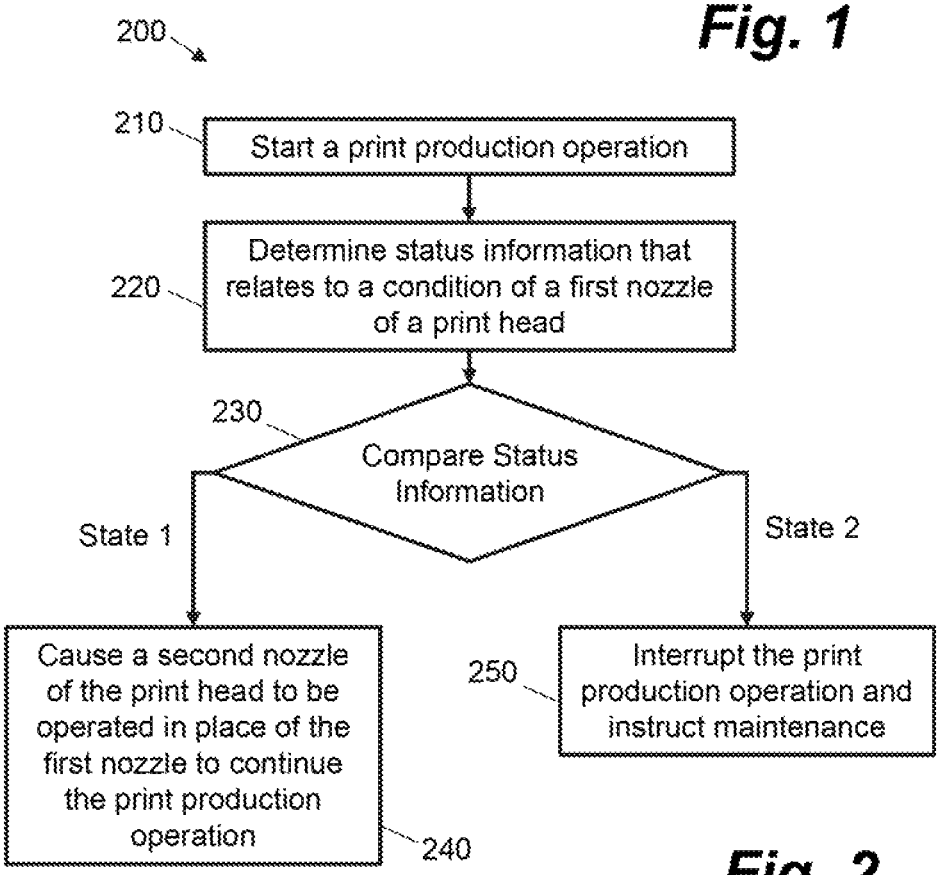
FIG. 2 is a flow chart showing a method for operating a printing system according to an example.

FIG. 2 shows a method 200 of operating a printing system according to an example. At block 210, a print production operation using the printing system is started. The printing system may comprise the printing system 100 shown in FIG. 1. At block 220, status information is determined during the print production operation that relates to a condition of a first nozzle of a print head. At block 230 the status information, which may comprise an image degradation metric, is compared to a plurality of ranges indicative of different nozzle operation states. The plurality of ranges may be associated with different bands or levels of image degradation. In FIG. 2, based on the status information determined at block 220, and the comparison at block 230, one of at least two actions is taken. If a first state is indicated, a second nozzle of the print head is caused, at block 240, to be operated in place of the first nozzle to continue the print production operation. If a second state is indicated, print production operation is interrupted at block 250 and a maintenance operation on the print head is instructed.

In one example, block 210 may be performed by the printing mechanism 110. In another example, block 210 may be performed by a control system of the printing system. Starting the print production operation may, according to one case, comprise receiving a user input via an interface of the printing system, and signaling to the printing mechanism to initiate a printing operation. In another case, a print production operation may start following a print job communicated by a print driver of a computer device. In certain examples, blocks 220 and 230 may be performed by the nozzle diagnostic mechanism 140 and block 240 may be performed by the nozzle compensator 150. In one case the nozzle diagnostic mechanism 140 may also perform block 250. According to various other examples, at least one of blocks 210 to 250 may be performed by a processor connectively coupled to a computer-readable storage medium.

In certain cases, causing the second nozzle to be operated in place of the first nozzle may comprise performing a predefined nozzle compensation procedure. The nozzle compensation procedure may comprise instructing nozzle compensation for the print head. In one example, the nozzle compensation procedure may comprise obtaining information indicative of an allocation of a second nozzle to replace the first nozzle and generating a signal relating to said allocation. The nozzle compensation procedure may further comprise, according to certain examples, receiving the generated signal relating to the allocation of a second nozzle, and causing the second nozzle to be fired and the first nozzle not to be fired during the second period of the established printing operation. Said receiving the generated signal and said causing the second nozzle to be fired and the first nozzle not to be fired may, according to one example, be performed by the print head of the printing system. In this case. "firing" a nozzle may be defined as activating a fluid ejection actuator associated with the nozzle, e.g. applying a voltage via print head control electronics.

Figure 3:
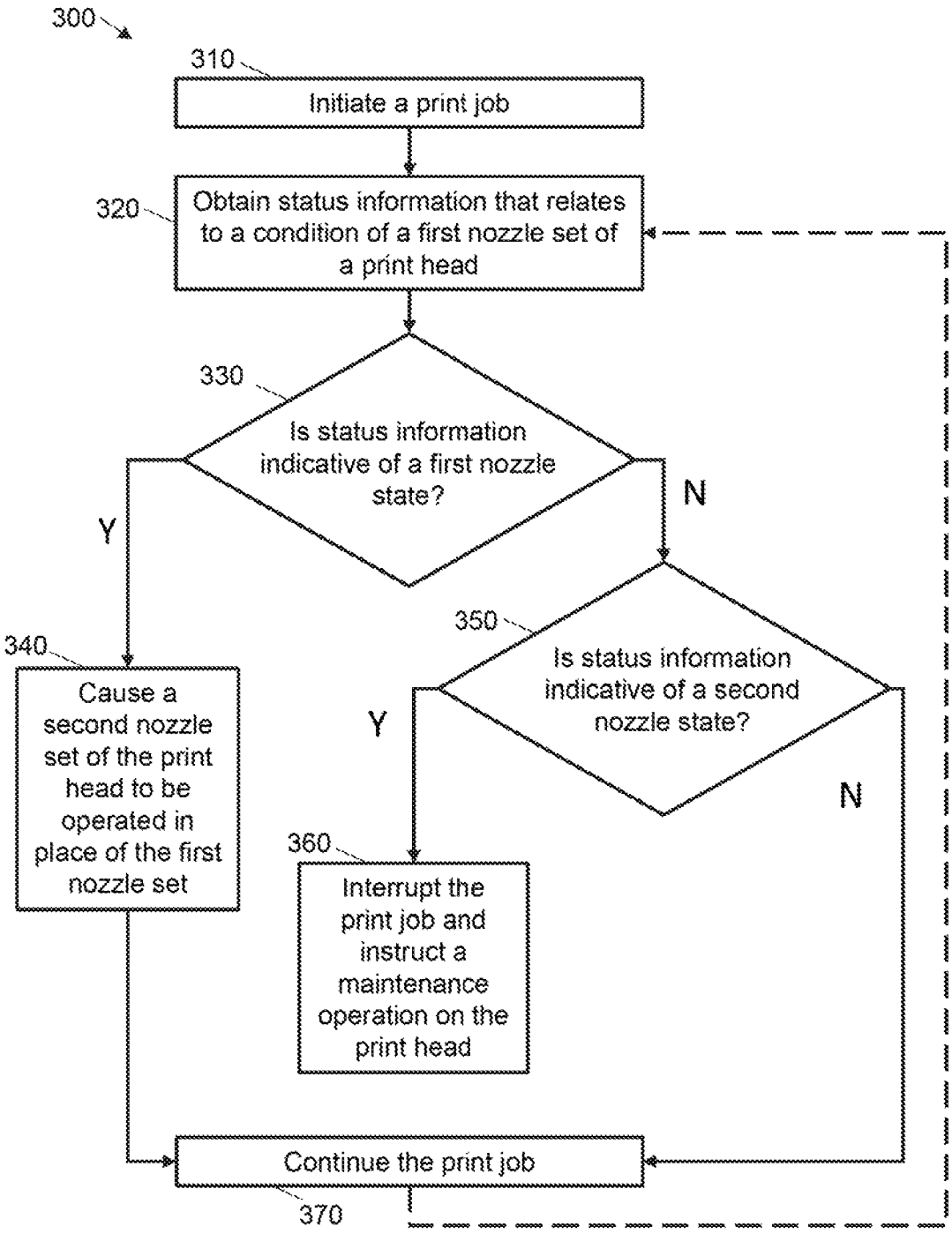
FIG. 3 is a flow chart showing a method for operating a printing system according to an example.

FIG. 3 shows a method 300 of operating a printing system according to an example. At block 310, a print job is initiated using the printing system. At block 320, status information is obtained that relates to a condition of a first nozzle set of a print head of the printing system. The status information is compared to a plurality of ranges indicative of different nozzle operation states. At block 330, it is determined whether the status information indicates a first nozzle operation state. If it is determined that the status information is indicative of the first nozzle operation state, a second nozzle set of the print head is caused, at block 340, to be operated in place of the first nozzle set to continue the print job at block 370. If it is determined, at block 330, that the status information is not indicative of the first nozzle operation state, it is determined, at block 350, whether the status information instead indicates a second nozzle operation state. If it is determined that the status information is indicative of the second nozzle operation state, a print job is interrupted at block 360. Further, at block 360, a maintenance operation on the print head is instructed. If it is determined, at block 350, that the status information is not indicative of the second nozzle operation state, the print operation is continued at block 370, without instructing a maintenance operation on the print head or causing the second nozzle set of the print head to be operated in place of the first nozzle set. Following the continuation of the print job at block 370, the obtaining of the status information at block 320 may be performed on at least one further occasion. Although blocks 330 and 350 are shown in this example as subsequent procedures, in other examples they may form part of a single comparison operation.

The obtaining of status information at block 320 may, according to one example, be performed on a further occasion to confirm the successful outcome of the nozzle compensation procedure performed at block 340. In another example, the obtaining of the status information at block 320 may be performed repeatedly throughout the duration of the print job. This is shown by the dotted line from block 370 to block 320 in FIG. 3. In a further example, the obtaining of the status information at block 320 may be performed whenever an image quality threshold is reached during the print job. Subsequent blocks 330, 340, 350, 360 and 370 may also be performed repeatedly throughout the duration of the print job, based on the repeated performance of block 320.

The first nozzle operation state may, according to one example, be based on whether compensation of the first nozzle set by a second nozzle set is determined to be suitable. The second nozzle operation state may, according to one example, be based on a determination that nozzle compensation is unsuitable. Nozzle compensation may be unsuitable due to the first nozzle set not being in a malfunctioning state. In this case, the print job may continue at block 370. Nozzle compensation may also be unsuitable due to a second nozzle set not being allocated to replace the first nozzle set. The second nozzle set not being allocated may occur, according to an example, if the number of malfunctioning nozzles of the print head exceeds a first threshold value. In another example, the second nozzle set not being allocated may occur if the number of redundant nozzles that are not malfunctioning falls below a second threshold value. In a further example, the second nozzle set not being allocated may occur if there is a fault in the nozzle compensator.

Figure 4A:
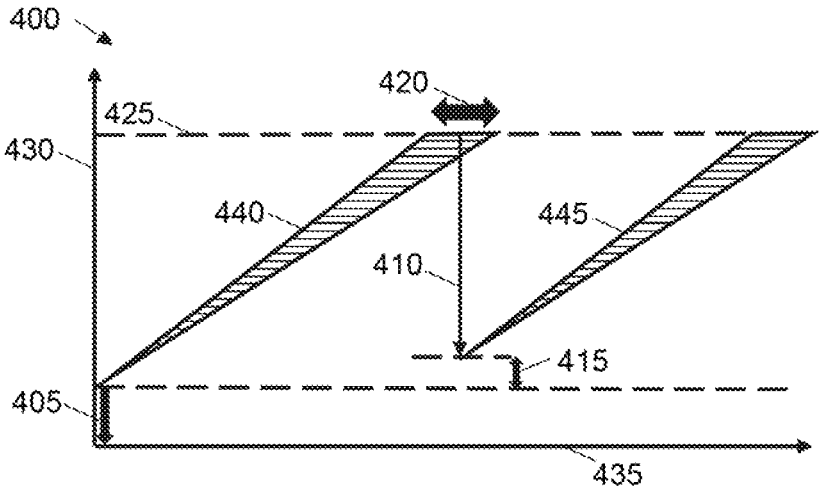
FIG. 4A is a graph showing a degradation of a plurality of nozzles of a print head during a printing operation versus time in a first case.

FIG. 4A is a graph 400 showing a degradation of a plurality of nozzles of a print head during a printing operation according to a first case. The first case comprises a comparative example wherein the examples of any one of FIGS. 1 to 3 are not used. Time is shown on the x axis 435 and a degradation metric is shown on the y axis 430. The degradation metric may be a function of a proportion of firing nozzles per print head. The degradation metric may be indicative of a measure of nozzle health deterioration, e.g. the larger the metric value the larger the nozzle health deterioration or print degradation. Portion 405 of FIG. 4A indicates that, in the comparative example, a printing operation begins with an initial set of malfunctioning or poorly functioning nozzles. This is effected because a nozzle compensation process in the comparative example may be performed using a historic list of malfunctioning or poorly functioning nozzles that does not reflect a current set of malfunctioning or poorly functioning nozzles. For example, in a comparative case, a nozzle health detection operation may be performed weekly or monthly, e.g. during scheduled downtime or maintenance. In this case a list of malfunctioning or poorly functioning nozzles may be updated weekly or monthly following this process, i.e. the list is not updated as part of a print operation. In FIG. 4A, from the starting point 405, the performance of a plurality of nozzles 440 is then shown to diminish over time during a first period of the printing operation. After a certain time from the start of the printing operation, e.g. around one hour, the deterioration of the nozzles results in an image quality threshold 425 being reached. At this moment, there is a distribution 420 of nozzle degradation amongst the plurality of nozzles 440. The printing operation is then interrupted and a maintenance or servicing operation is instructed as indicated by the reduction in the degradation metric shown at 410, which may involve cleaning, repairing or replacing the print head. In this comparative case updating of a list of malfunctioning or poorly functioning nozzles is not performed at stage 410. Ongoing permanent deterioration, as well as the performance and repeatability of the servicing operation may lead to an offset 415 in nozzle performance as the printing operation is continued. For example, this may indicate an additional deviation between a historic list of malfunctioning or poorly functioning nozzles and a current set of malfunctioning or poorly functioning nozzles. The nozzles then continue to deteriorate 445 during a second period of the printing operation. This cycle then continues until a scheduled nozzle health detection operation. It should be noted that the model shown in the graph 400 does not account for sudden degradation due to external factors, such as a print medium crashing into the print head.

Figure 4B:
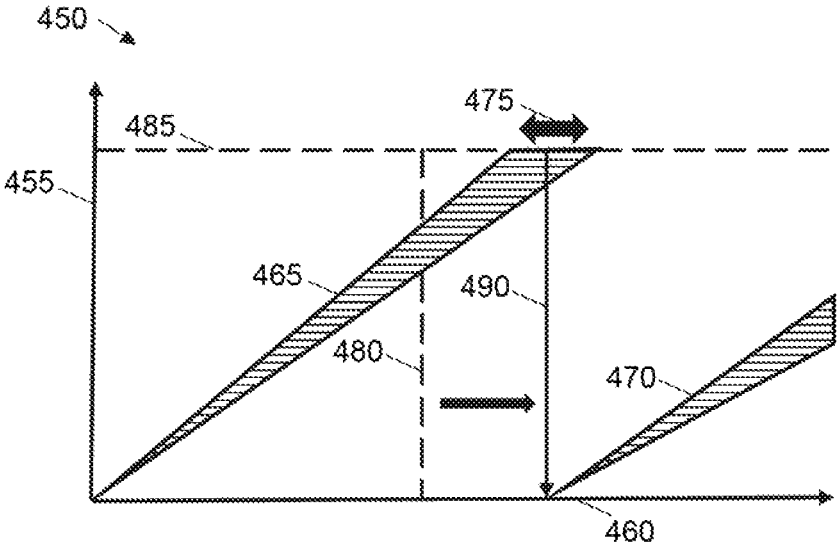
FIG. 4B is a graph showing a degradation of a plurality of nozzles of a print head during a printing operation versus time in a second case.

FIG. 4B is a graph 450 showing a degradation of a plurality of nozzles of a print head during a printing operation according to one of the examples described in the present disclosure. Time is shown on the x axis 460 and a degradation metric is shown on the y axis 455. The degradation metric may again be a function of a proportion of firing nozzles per print head or a measure of nozzle health deterioration. Nozzle compensation is instructed at the commencement of the printing operation, resulting in a "zeroing" of the initial degradation state, before the performance of the plurality of nozzles 465 degrades over time. As described herein, this involves obtaining information relating to the health condition of nozzles before applying nozzle compensation. As such, nozzle compensation is applied to a current set of malfunctioning or poorly functioning nozzles, resulting in the removal of "zero-state" portion 405 in FIG. 4B. A time longer than the previous servicing period 480 (e.g. time 410 in FIG. 4A) may therefore pass before the degradation of the plurality of nozzles 465 reaches the IQ threshold 485 (this being the same as the IQ threshold 425 in FIG. 4A). Also, certain examples as described herein are more robust to nozzles that degrade under a stress condition. For example, in the case of FIG. 4A, regular cleaning of nozzles at stage 410 may lead to these nozzles recovering temporarily but they may then fail again due to the stresses of a subsequent printing operation. Moreover, these temporarily recovered nozzles may fail fairly early in the subsequent printing operation. However, in certain examples described herein, these failing nozzles are detected and compensated for. When the nozzle degradation reaches this threshold, there is a distribution 475 of nozzle degradation amongst the plurality of nozzles 465. Status information is then obtained relating to a condition of at least one nozzle of the print head. The status information is then compared to a plurality of ranges indicative of different nozzle operation states. Responsive to the status information indicating a first nozzle operation state, nozzle compensation is instructed at stage 490 for the print head. The printing operation is then continued. This cycle of printing and compensation may then be continued until no longer effective, e.g. until a measure of malfunctioning nozzles is greater than a predefined threshold.

In one example, as a consequence of performing the nozzle compensation procedure 490, nozzles which have a relatively high likelihood of failing may be detected and compensated for, resulting in a reduced rate of degradation 470 for the second period of the printing operation. Furthermore, by avoiding a maintenance operation during the printing operation, the offset 415 in nozzle performance due to permanent degradation and maintenance repeatability may be diminished.

As described herein nozzle compensation functions, e.g. control routines that instruct the firing of particular redundant nozzles, may be used to compensate for malfunctioning nozzles. Nozzle compensation may comprise analyzing a health map that maps the health or functionality of a set of nozzles of the print head, and allocating one or more redundant nozzles to replace one or more malfunctioning nozzles, thereby improving the operability of the print head without the need for servicing.

Figure 5:
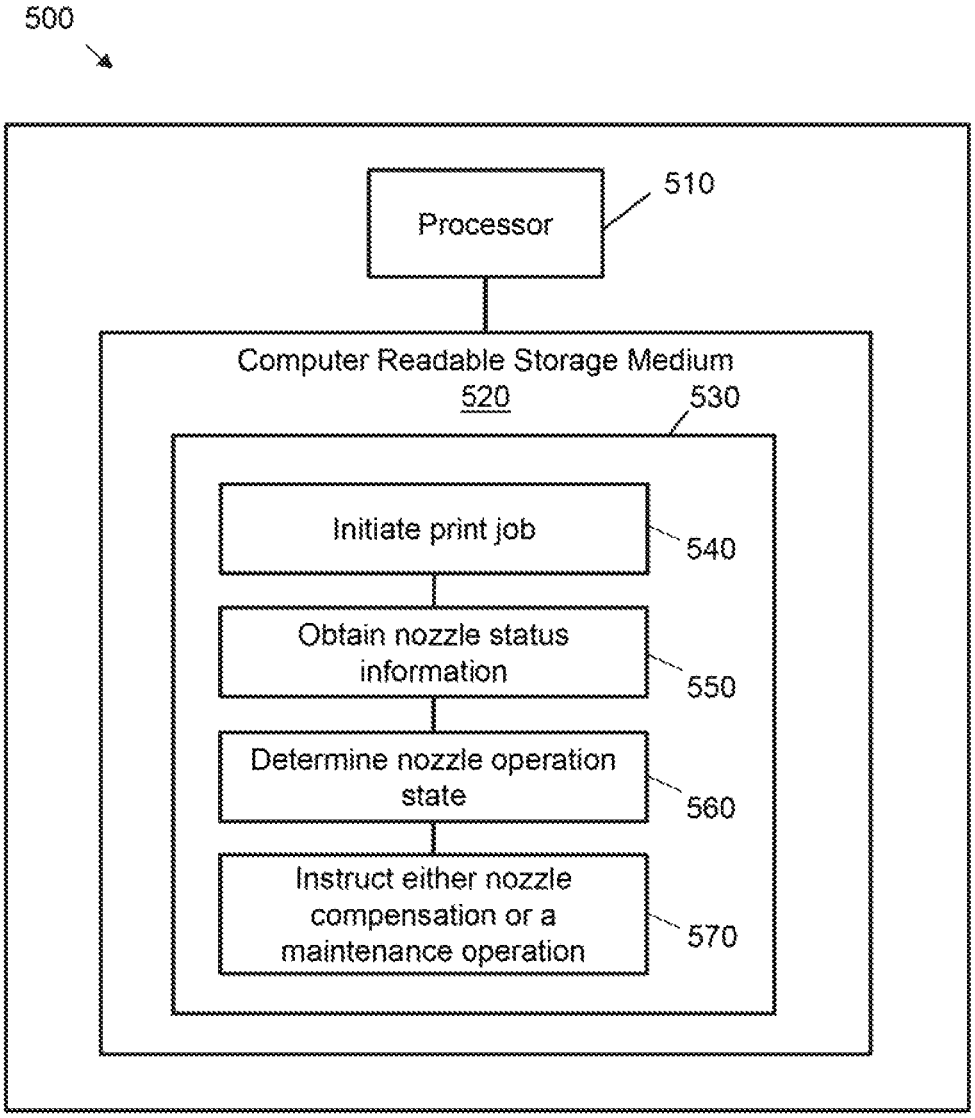
FIG. 5 is a schematic illustration showing a processor and a computer readable storage medium with instructions stored thereon according to an example.

FIG. 5 shows example components of a printing system 500, which may be arranged to implement certain examples described herein. A processor 510 of the printing system 500 is connectably coupled to a computer-readable storage medium 520 comprising a set of computer-readable instructions 530 stored thereon, which may be executed by the processor 510. Instruction 540 instructs the processor to initiate a print job on the printing system 500. Instruction 550 instructs the processor to obtain status information that relates to at least one nozzle of a print head of the printing system 500. Instruction 560 instructs the processor to compare the status information obtained at block 550 to a plurality of ranges indicative of different nozzle operation states. Based on the comparison, the processor is instructed to perform one of at least two operations via instruction 570. Responsive to the status information indicating a first nozzle operation state, the processor is instructed to, as a first operation, apply nozzle compensation for the print head during the print job. As a second operation, responsive to the status information indicating a second nozzle operation state, the processor is instructed to interrupt the print job and initiate a maintenance operation on the print head.

Processor 510 can include a microprocessor, microcontroller, processor module or subsystem, programmable integrated circuit, programmable gate array, or another control or computing device. The computer-readable storage medium 520 can be implemented as one or multiple computer-readable storage media. The computer-readable storage medium 520 includes different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. The computer-readable instructions 530 can be stored on one computer-readable storage medium, or alternatively, can be stored on multiple computer-readable storage media. The computer-readable storage medium 520 or media can be located either in the printing system 500 or located at a remote site from which computer-readable instructions can be downloaded over a network for execution by the processor 510.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of a printing system, the method comprising:

starting a print operation using the printing system;

determining, during the print operation, first status information that relates to a condition of a first nozzle set of a print head, and second status information that relates to a condition of a second nozzle set of the print head;

comparing the first status information to a plurality of ranges indicative of different nozzle operation states;

in response to determining from the first status information that a number of malfunctioning nozzles in the first nozzle set does not exceed a first threshold value and determining from the second status information that a number of redundant nozzles in the second nozzle set exceeds a second threshold value, causing a second nozzle set including the redundant nozzles of the print head to be operated in place of the first nozzle set to continue the print operation; and in response to determining from the first status information that that the number of malfunctioning nozzles in the first nozzle set exceeds the first threshold value, interrupting the print operation and instructing a maintenance operation on the print head.

2. The method of claim 1, comprising:

responsive to the first status information indicating that the first nozzle set is able to perform the print operation with a print quality metric that is above a quality threshold, continuing the print operation without instructing the maintenance operation on the print head or causing the second nozzle set of the print head to be operated in place of the first nozzle set.

3. The method of claim 1, wherein at least the determining of the first status information is performed repeatedly during the print operation.

4. The method of claim 1, wherein the first status information is based on information obtained during a previous print operation.

5. The method of claim 1, further comprising interrupting the print operation in response to determining from the first status information that the number of malfunctioning nozzles in the first nozzle set does not exceed the first threshold value and determining from the second status information that the number of redundant nozzles in the second nozzle set does not exceed the second threshold value.

6. The method of claim 5, wherein causing the second nozzle set to be operated in place of the first nozzle set allows the print operation to continue without interruption.

7. The method of claim 5, wherein the determining of the number of malfunctioning nozzles in the first nozzle set and the determining of the number of redundant nozzles in the second nozzle set are performed in a first time period, and the causing of the second nozzle set to be operated in place of the first nozzle set or the interrupting of the print operation is performed in a second time period after the first time period.

8. The method of claim 1, further comprising:

detecting a malfunctioning nozzle in the first nozzle set by:

printing, using the first nozzle set, a calibration pattern onto a print medium;

receiving information acquired by a sensor of the printed calibration pattern; and identifying, based on the received information acquired by the sensor, a particular nozzle in the first nozzle set as malfunctioning in response to detecting absence of a mark corresponding to the particular nozzle being absent.

9. A non-transitory computer-readable storage medium comprising computer-readable instructions that when executed cause a system to:

initiate a print job on a printing system;

obtain first status information that relates to a first nozzle set of a print head of the printing system;

obtain second status information that relates to a second nozzle set of the print head;

in response to determining from the first status information that the first nozzle set comprises malfunctioning nozzles and determining from the second status information that a number of redundant nozzles in the second nozzle set exceeds a first threshold, instruct nozzle compensation for the print head during the print job by using the redundant nozzles of the second nozzle set in place of the malfunctioning nozzles in the first nozzle set for the print job; and in response to determining from the first status information that the first nozzle set comprises the malfunctioning nozzles and determining from the second status information that the number of redundant nozzles in the second nozzle set does not exceed the first threshold, interrupt the print job and instruct a maintenance operation on the print head.

10. The non-transitory computer-readable storage medium of claim 9, wherein the instructions when executed cause the system to:

responsive to the first status information indicating that the first nozzle set is without malfunctioning nozzles, continue the print job on the printing system without instructing the nozzle compensation and without instructing the maintenance operation on the print head.

11. The non-transitory computer-readable storage medium of claim 9, wherein the first status information relates to a health condition of the nozzles in the first nozzle set.

12. The non-transitory computer-readable storage medium of claim 9, wherein obtaining the first status information and obtaining the second status information are performed repeatedly during the print job.

13. The non-transitory computer-readable storage medium of claim 9, wherein instructing the nozzle compensation is further in response to determining from the first status information that a number of the malfunctioning nozzles in the first nozzle set does not exceed a second threshold.

14. The non-transitory computer-readable storage medium of claim 13, wherein interrupting the print job is performed in response to determining from the first status information that the number of the malfunctioning nozzles in the first nozzle set exceeds the second threshold.

15. The non-transitory computer-readable storage medium of claim 14, wherein instructing the nozzle compensation allows the print job to continue without interruption.

16. The non-transitory computer-readable storage medium of claim 9, wherein the instructions when executed cause the system to detect a malfunctioning nozzle in the first nozzle set by:

cause printing, using the first nozzle set, a calibration pattern onto a print medium;

receive information acquired by a sensor of the printed calibration pattern; and identify, based on the received information acquired by the sensor, a particular nozzle in the first nozzle set as malfunctioning in response to detecting absence of a mark corresponding to the particular nozzle being absent.

* * * * *